US009309097B2

(12) United States Patent
O'Keeffe

(10) Patent No.: US 9,309,097 B2
(45) Date of Patent: Apr. 12, 2016

(54) LINKAGE SYSTEM FOR A FORKLIFT TRUCK

(75) Inventor: Eric O'Keeffe, Monaghan (IE)

(73) Assignee: Terberg Kinglifter B.V., Ijsselstein (NL)

( * ) Notice: Subject to any disclaimer, the term of this patent is extended or adjusted under 35 U.S.C. 154(b) by 1060 days.

(21) Appl. No.: 13/496,854

(22) PCT Filed: Sep. 20, 2010

(86) PCT No.: PCT/EP2010/063815
§ 371 (c)(1),
(2), (4) Date: Jun. 28, 2012

(87) PCT Pub. No.: WO2011/033111
PCT Pub. Date: Mar. 24, 2011

(65) Prior Publication Data

US 2012/0263565 A1 Oct. 18, 2012

(30) Foreign Application Priority Data

Sep. 18, 2009 (IE) ..... S2009/0712

(51) Int. Cl.
*B66F 9/00* (2006.01)
*B66F 9/12* (2006.01)
*B66F 9/14* (2006.01)

(52) U.S. Cl.
CPC ..... *B66F 9/122* (2013.01); *B66F 9/146* (2013.01)

(58) Field of Classification Search
CPC ..... B66F 9/122; B66F 9/147; B66F 9/146; B66F 9/14
USPC ..... 414/662, 663, 667
See application file for complete search history.

(56) References Cited

U.S. PATENT DOCUMENTS 3,082,894 A 3/1963 Gibson
3,528,579 A 9/1970 Ulinski
3,599,818 A * 8/1971 Stanton ..... 414/607

(Continued)

FOREIGN PATENT DOCUMENTS

FR 1142453 9/1957
FR 2180984 A1 11/1973

(Continued)

*Primary Examiner* — Kaitlin Joerger
(74) *Attorney, Agent, or Firm* — Knobbe, Martens, Olson & Bear, LLP

(57) ABSTRACT

Forklift truck (100) includes a linkage system (300) which comprises first link arm (1) pivotally connected at one end to roller (1.4) at point (1.1) which is vertically movable within channel (6.1) of mounting carriage/member (6), and to forks (4) at the opposite end via fork carriage (5) at pivot point (1.3). Second link arm (2) is pivotally connected to first link arm (1) at pivot point (1.2). The opposite end of second link arm (2) is pivotally connected to mounting carriage/member (6) at pivot point (2.1). Pivot points (1.1) and (2.1) are positioned on or near the center line of channel (6.1). The tilt angle of forks (4) and fork carriage (5) is restricted by link arm (3) which is pivotally connected at one end to second link arm (2) at pivot point (3.2) and pivotally connected at the opposite end to fork carriage (5) at pivot point (3.1). During operation link arm (3) forces fork carriage (5) to rotate about pivot point (1.3) to compensate for the continuously changing angle of first link arm (1) while maintaining a generally fixed angle to channel (6.1) thus ensuring forks (4) remain substantially horizontal throughout the movement of the linkage system.

20 Claims, 15 Drawing Sheets

(56) References Cited

U.S. PATENT DOCUMENTS

Figure 6:
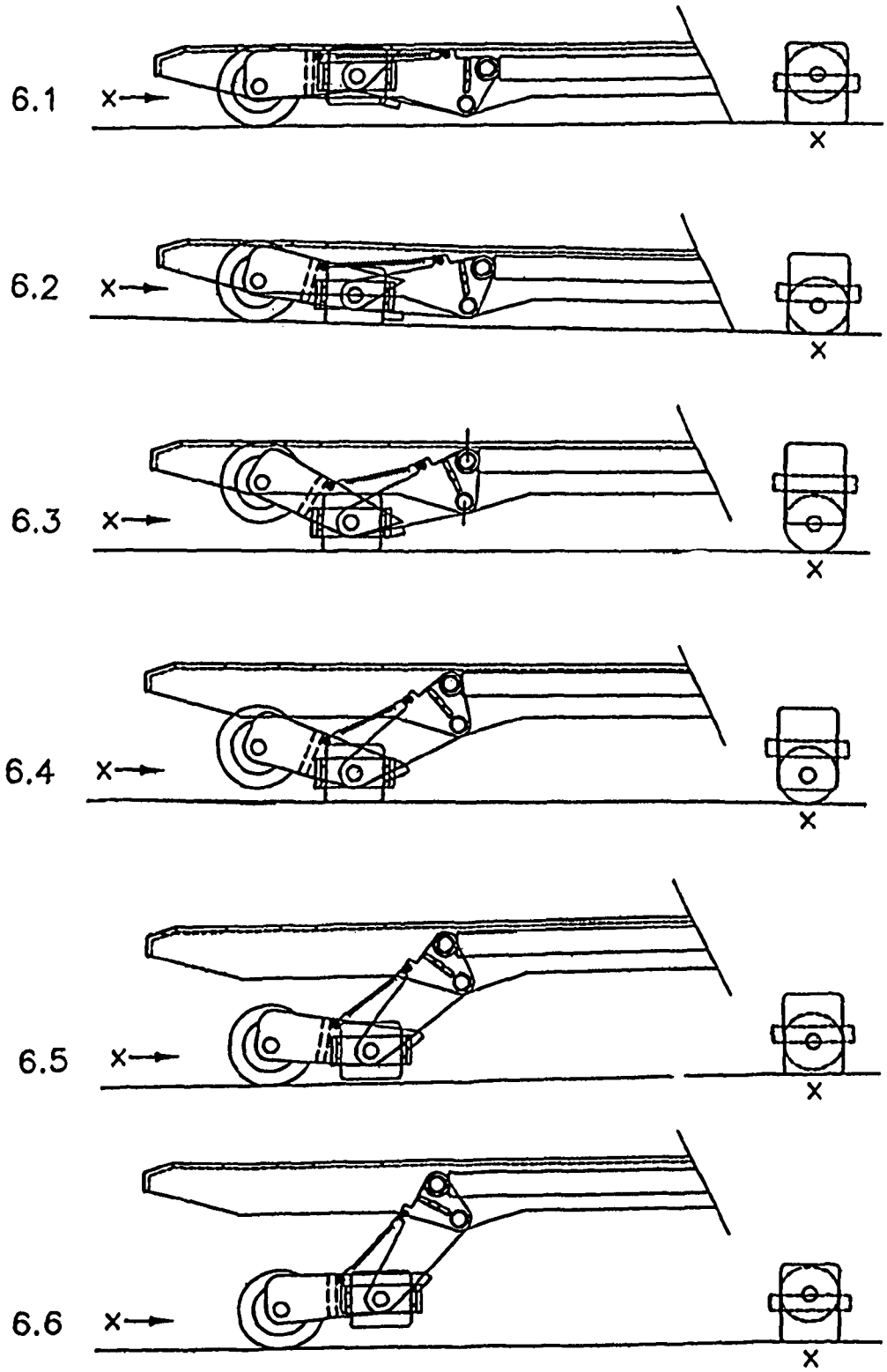

| | | | | | |
|---|---|---|---|---|---|
| 3,762,588 | A | * | 10/1973 | Hansen et al. | 414/666 |
| 4,069,932 | A | * | 1/1978 | Stedman | 414/664 |
| 4,268,210 | A | * | 5/1981 | Ferguson et al. | 414/497 |
| 4,395,190 | A | * | 7/1983 | Barchard | 414/664 |
| 4,402,644 | A | * | 9/1983 | Barchard | 414/416.04 |
| 4,810,161 | A | * | 3/1989 | Dady, Sr. | 414/700 |
| 6,079,935 | A | * | 6/2000 | Brunner et al. | 414/641 |
| 2012/0171004 | A1 | * | 7/2012 | Jones et al. | 414/664 |

FOREIGN PATENT DOCUMENTS

| | | |
|---|---|---|
| GB | 1407286 | 9/1975 |
| GB | 1429785 | 3/1976 |
| NL | 8300147 A | 8/1984 |

* cited by examiner

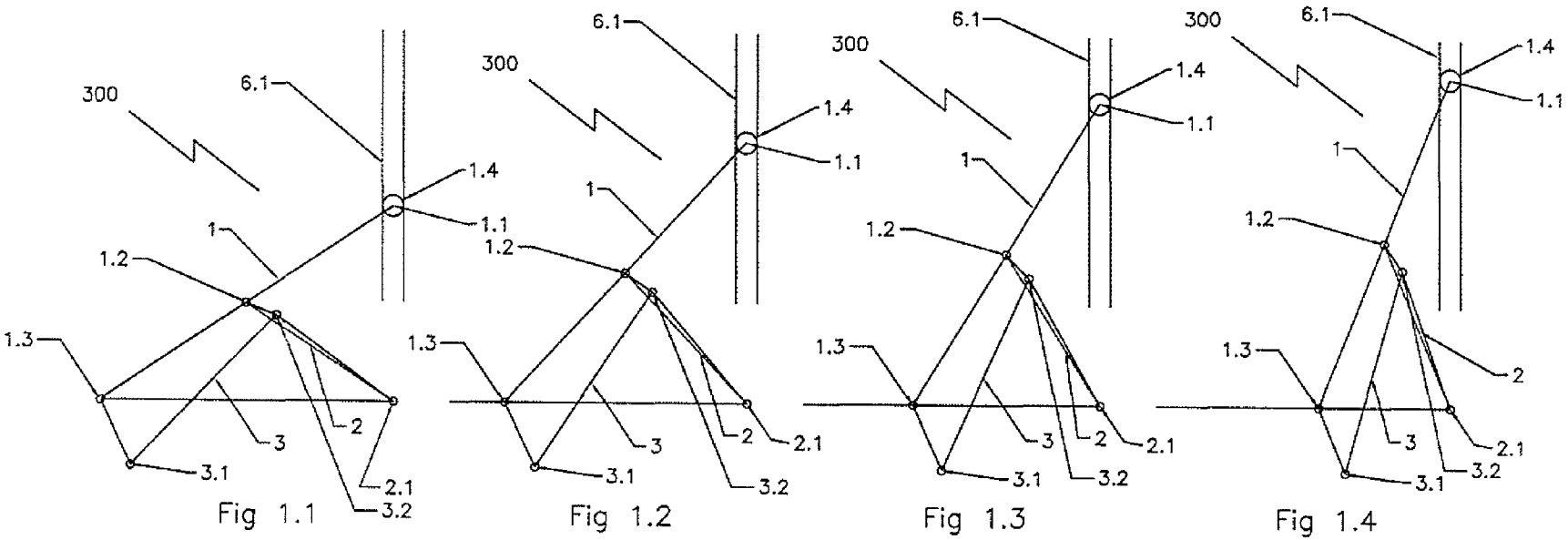
Fig 1.1
Fig 1.2
Fig 1.3
Fig 1.4

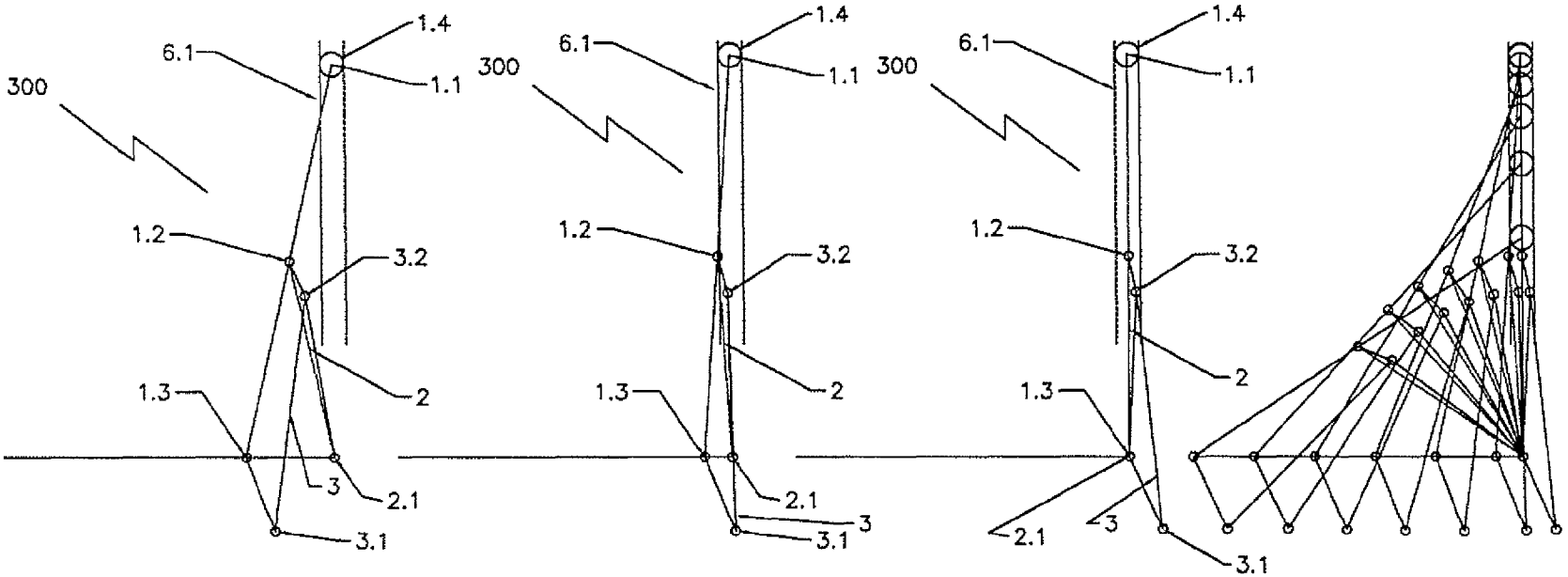
Fig 1.5
Fig 1.6
Fig 1.7
Fig 1.8

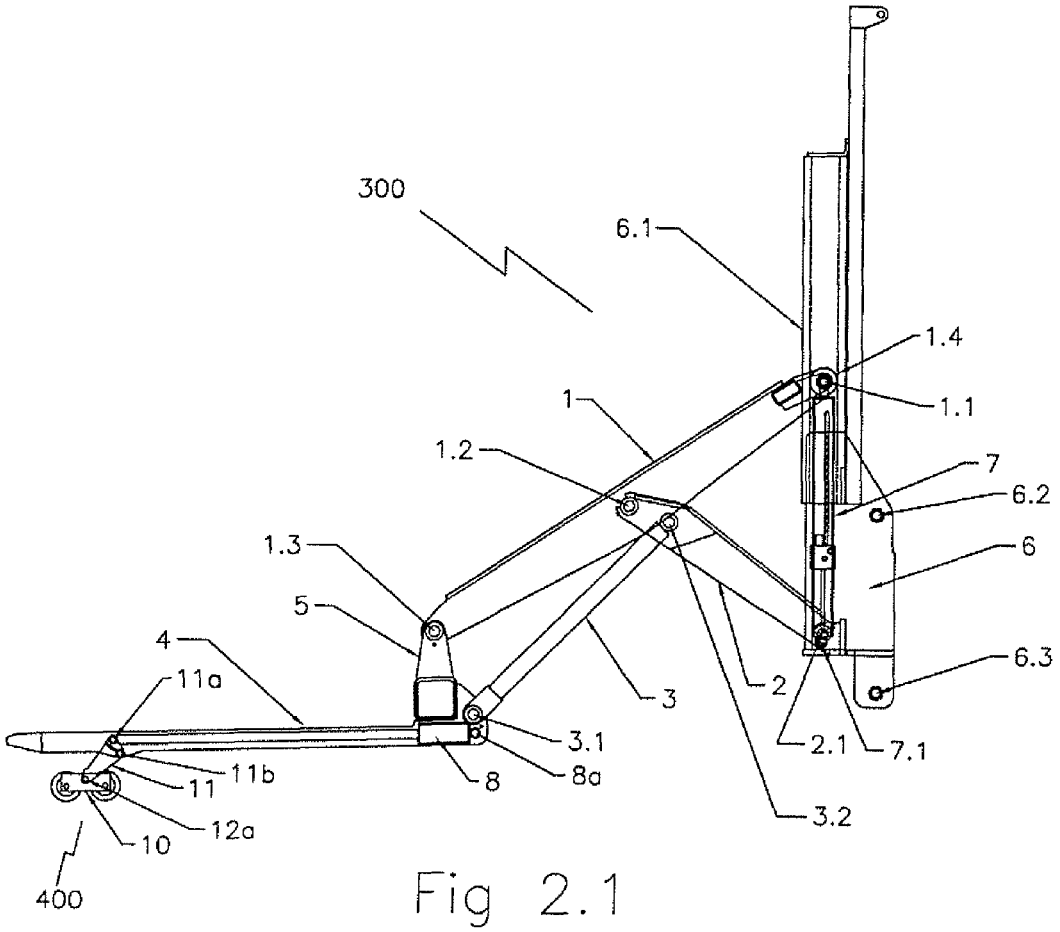
Fig 2.1

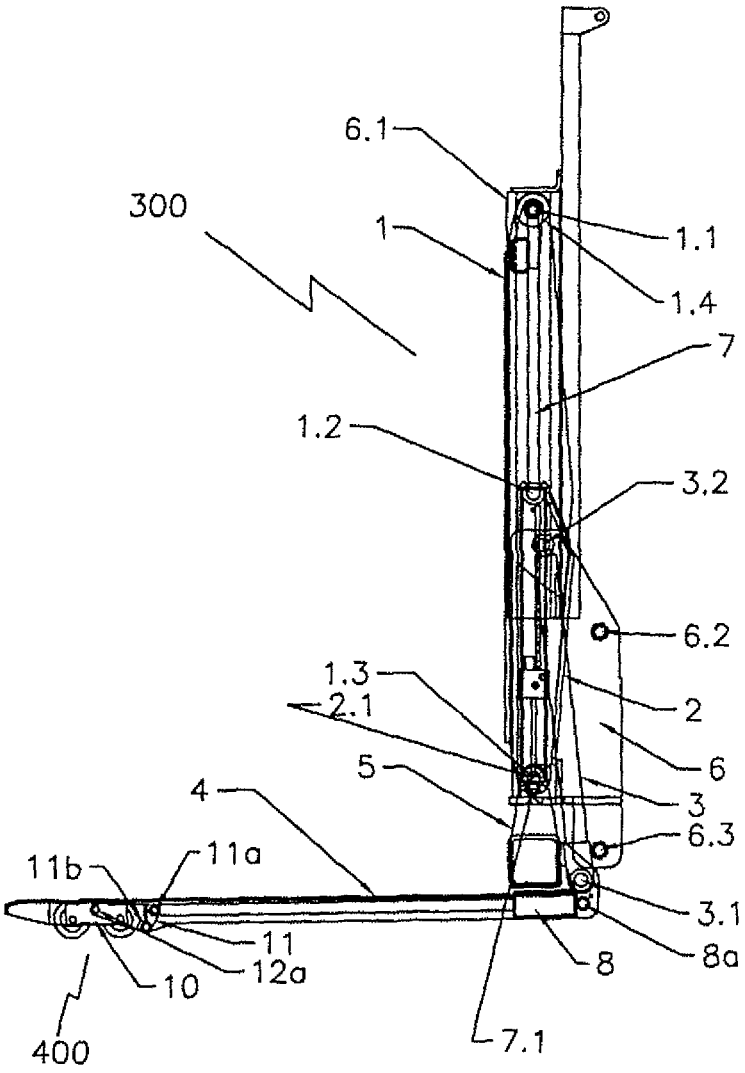
Fig 2.2

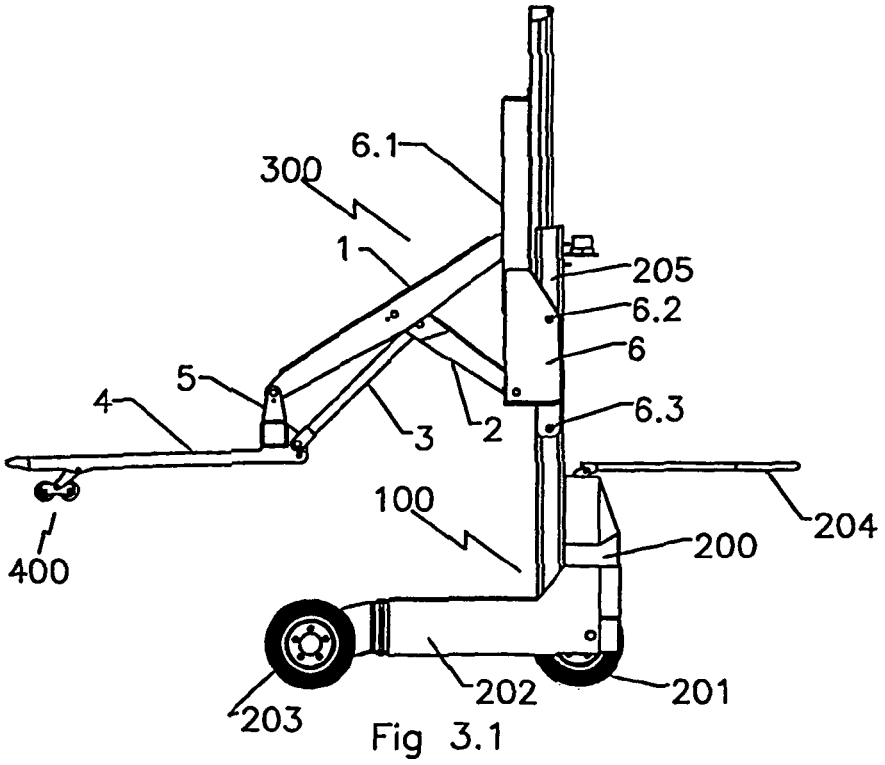
Fig 3.1
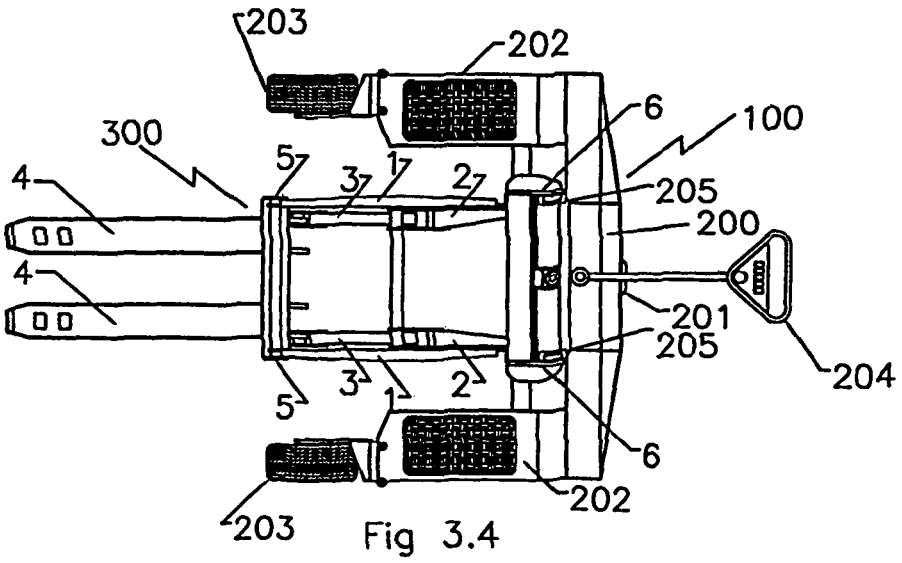
Fig 3.4

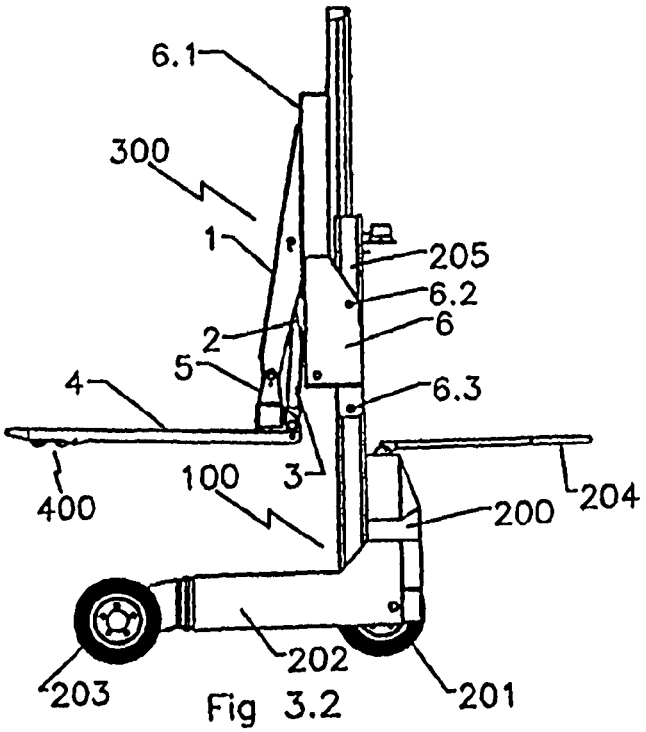
Fig 3.2
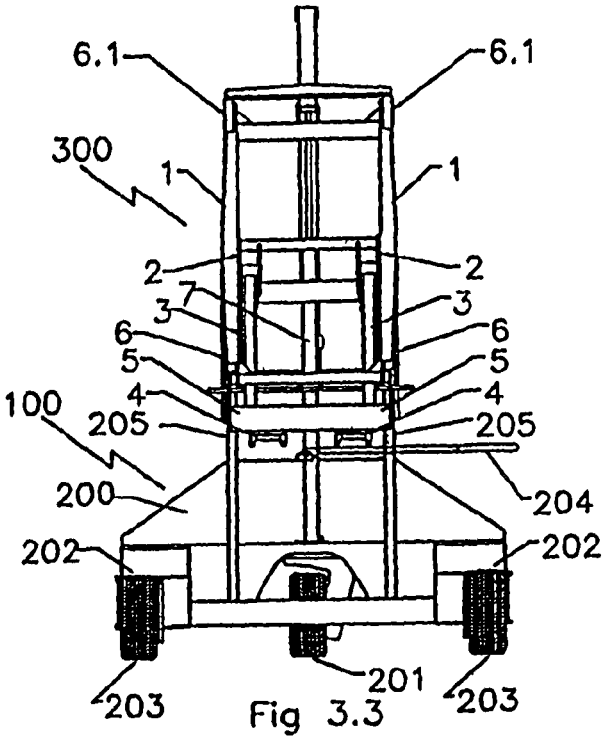
Fig 3.3

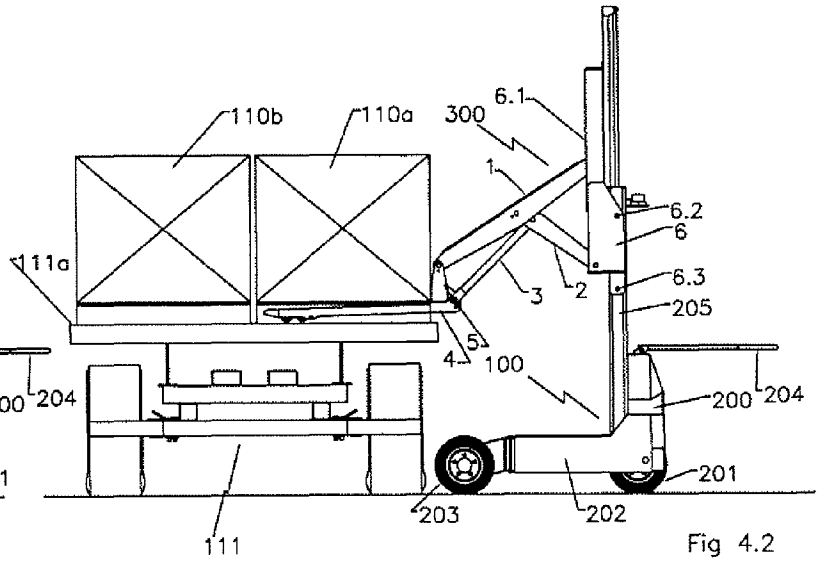
Fig 4.2
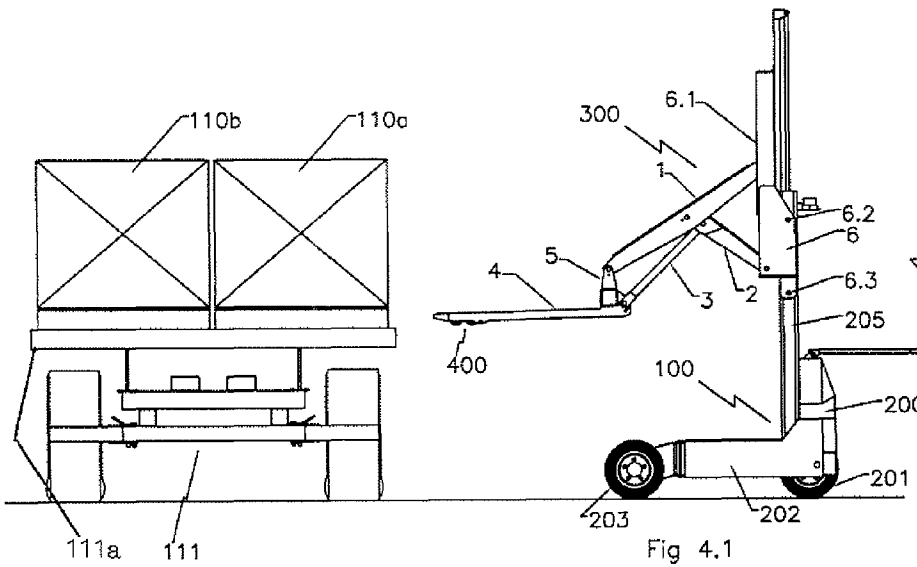
Fig 4.1

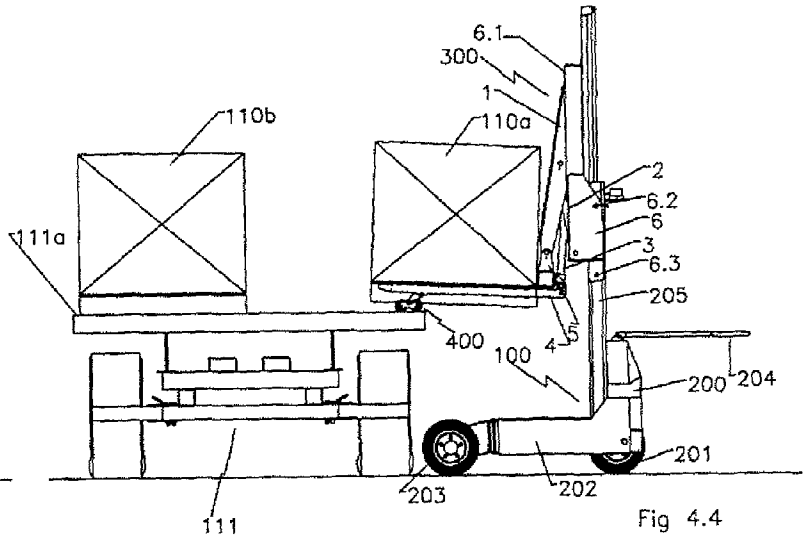
Fig 4.4
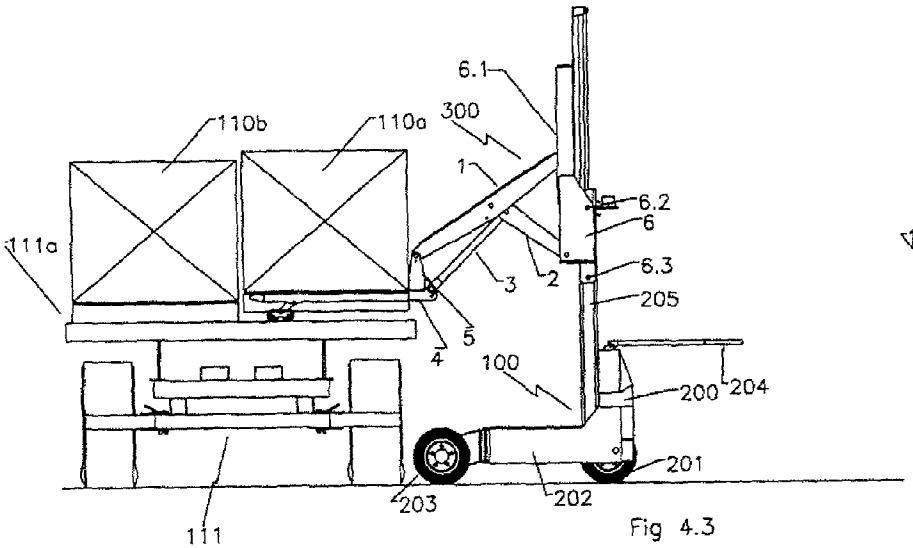
Fig 4.3

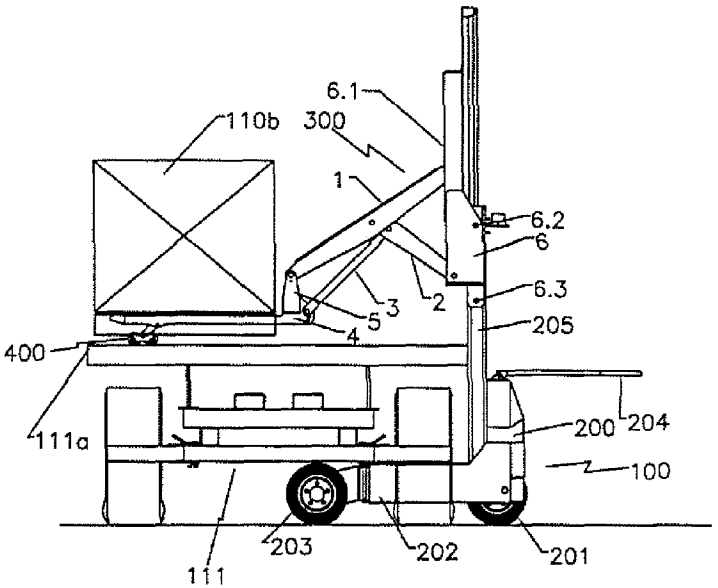
FIG 5.2
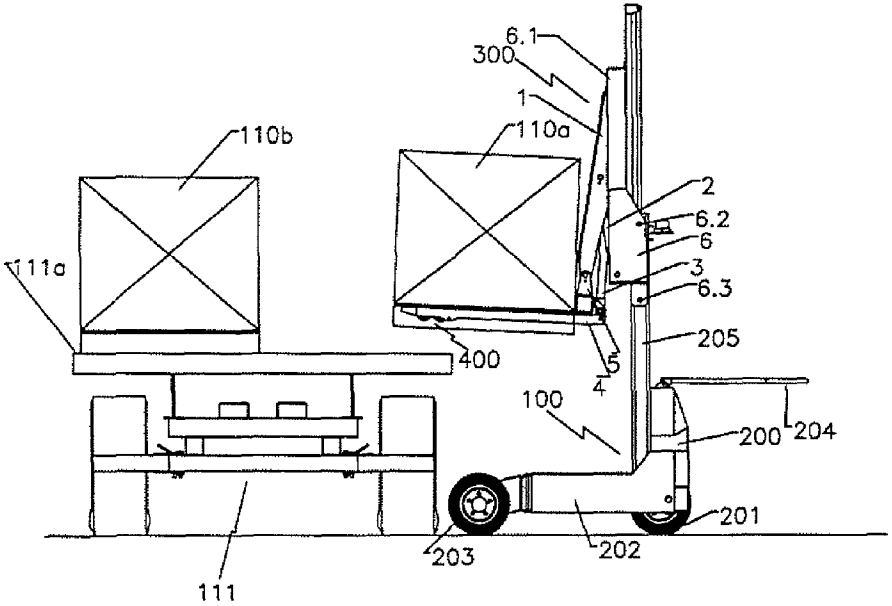
FIG 5.1

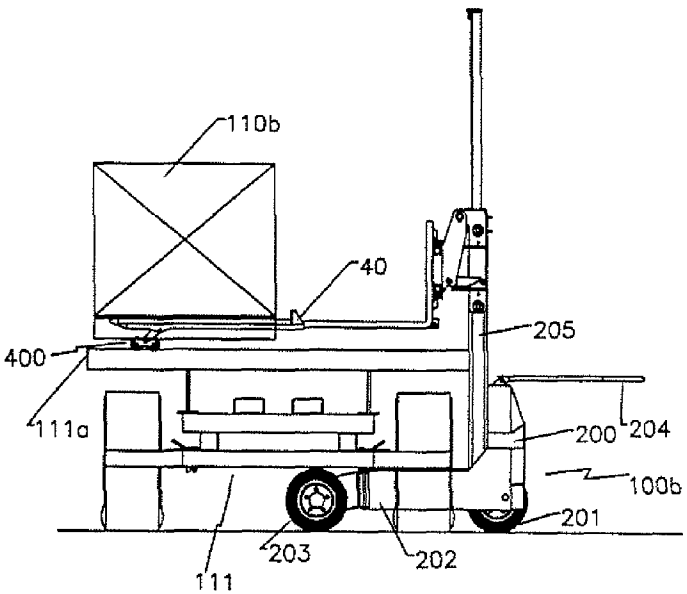
FIG 5.4
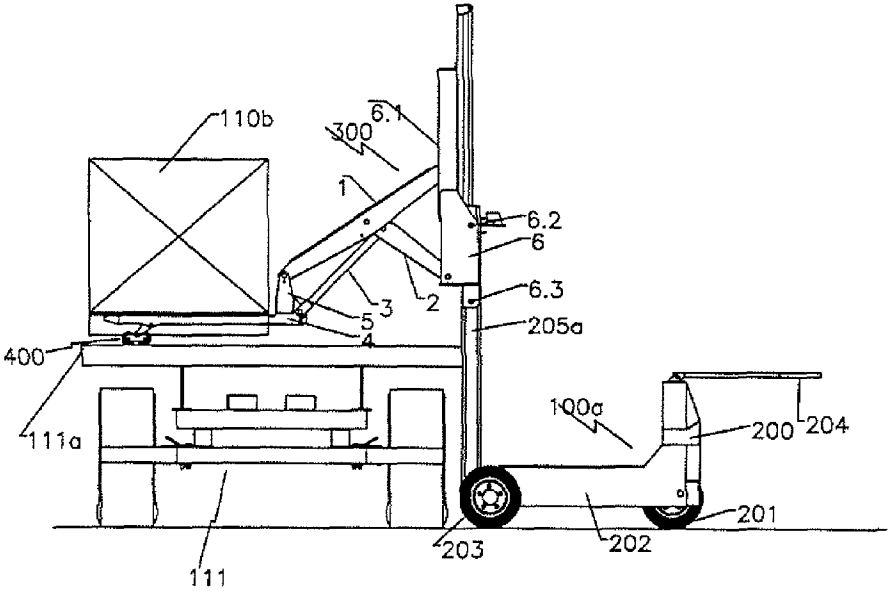
FIG 5.3

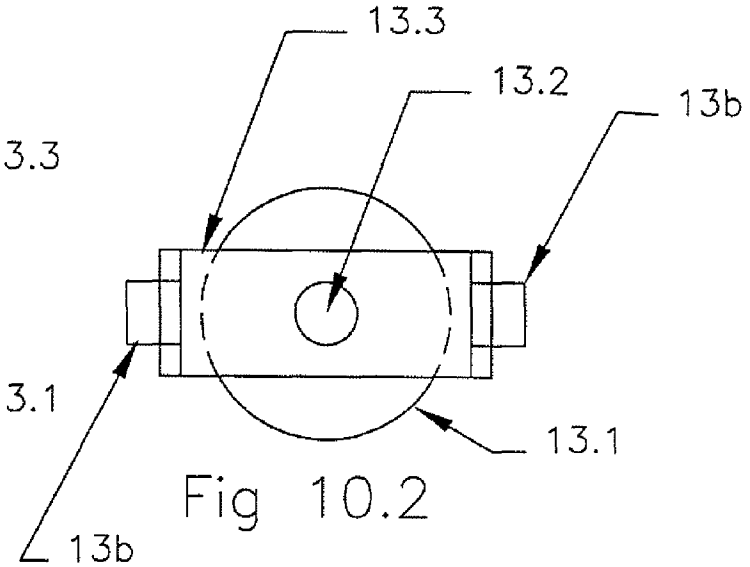
Fig 10.2
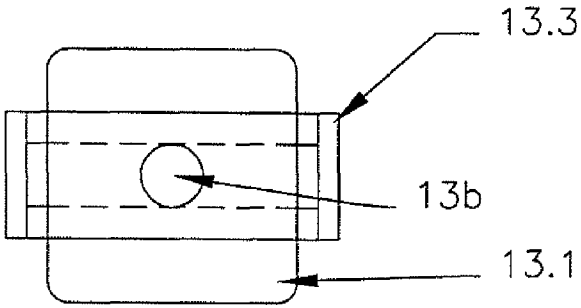
Fig 10.1
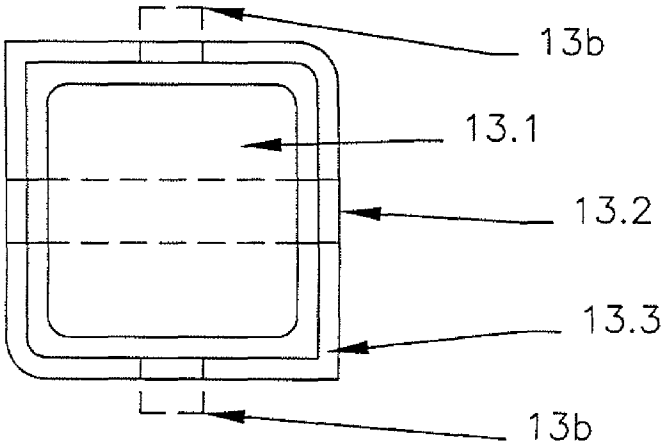
FIG 10.3

LINKAGE SYSTEM FOR A FORKLIFT TRUCK

RELATED APPLICATIONS

This application is the U.S. National Phase under 35 U.S.C. §371 of International Application No. PCT/EP2010/063815 entitled A LINKAGE SYSTEM FOR A FORKLIFT TRUCK, filed Sep. 20, 2010, designating the U.S. and published in English on Mar. 24, 2011 as WO 2011/033111, which claims priority under 35 U.S.C. §119(a)-(d) to Ireland Patent Application No. S2009/0712, filed Sep. 18, 2009.

The present invention relates to a linkage system for a forklift truck and a wheeled stabilisation mechanism suitable for use with a forklift truck.

It is known to use forklift trucks to remove and place loads on surfaces of varying depths and heights. Such forklifts generally comprise a wheeled chassis on which is mounted an upright mast and means for carrying loads. Usually the means for carrying loads are in the form of L shaped members such as forks or tines that are able to engage the load to be carried. For the purpose of this specification and unless otherwise noted explicitly, the terms load carrying means, forks or tines shall be used interchangeable to describe the means by which a forklift truck carries its load. It is also known that such forklift trucks can be adapted to be mounted on a carrying vehicle. These forklift trucks are conventionally known as 'truck mounted' forklifts or 'piggy-back' forklifts.

Conventional forklifts are rated for loads at a specific maximum weight when at a specified forward centre of gravity. The forklift and load are regarded as a unit that has a continually varying centre of gravity with every movement of the load. Accordingly all forklift trucks have to be designed to provide enough counterbalance to counteract the tipping moment caused by lifting the specified rated load capacity for stacking. More importantly the forklift truck must also have enough counter-balancing weight for travelling mode where the dynamic forces experienced require greatly increased stability.

Conventional counterbalance forklifts carry extra counterbalance weight on the rear of the truck to ensure safe operation while stacking or travelling. However, truck mounted forklifts are generally of straddle frame construction which enables the load to be carried substantially between the front wheels during travelling mode. This greatly improves stability without the requirement for additional counterweight. However, straddle frame construction generally requires a reach system to enable the forks to engage the load especially on a trailer bed or raised platform.

Generally, reach systems comprise, for example, moving mast systems, telescopic forks or pantograph linkage arrangements. When the forks are in an extended position, the load capacity that can be borne by the forks is substantially reduced. This can be overcome with a combination of additional machine weight, extra counter weight and stabiliser or jack legs mounted in the front of the forklift. However, truck mounted fork lifts must be of lightweight construction in order to ensure that they can be mounted on the carrying vehicle. It is therefore advantageous to employ means to increase forklift capacity without increasing the forklift weight.

A pantograph reach system and telescopic forks tilt from the mast or fork carriage. This results in a magnification of tilt moment as the reach of the forks is extended from the upright mast. The practical effect of this is increased tilt stresses and reduced control of the tilt function.

Further problems associated with both pantograph reach systems and telescopic forks are increased costs. Telescopic forks whilst being the most compact of the above three systems are an extremely expensive component for forklift trucks. The means by which the pantograph system operates requires a duplication of components, for example linkage pieces, channels, bearings and so forth to operate. Not only does this increase to cost of the forklift truck is also creates additional weight that the forklift must counterbalance in order to operate effectively at extended reach. Furthermore the pantograph system forms a substantially increased overhang when the forklift is mounted on a carrying vehicle. This causes a problem due to strict road transport regulations for carrying vehicles such as trucks or lorries.

Each of the aforementioned problems are of increased importance when the forklift is required to reach across a trailer bed to offload a pallet without moving the forklift to the other side of the trailer. This is known as a double reach system. These systems normally comprise one or more of the aforementioned systems for examples, a combination of telescopic forks attached to a moving mast system, telescopic forks attached to a pantograph system or a pantograph system used in conjunction with a moving mast system.

It is therefore an object of the present invention to provide a linkage system and wheeled stabilisation mechanism that are designed to overcome the aforementioned problems.

It is acknowledged that the term 'comprise' may, under varying jurisdictions be provided with either an exclusive or inclusive meaning. For the purpose of this specification, and unless otherwise noted explicitly, the term comprise shall have an inclusive meaning that it may be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

Further aspects of the present invention will become apparent from the ensuing description which is given by way of example only.

According to a first aspect of the invention there is provided a linkage system for movement, comprising;

- a moveable means contained within a channel;
- a first link arm pivotally connected to the moveable means at a first pivot point and a connecting link member at a second pivot point;
- a second link arm pivotally connected substantially near a midpoint of the first link arm at a third pivot point and at a fixed point relative to the channel substantially near a centreline of the channel at a forth pivot point;
- a third link means pivotally connected to the second link arm at a fifth pivot point and to the connecting link member at a sixth pivot point at the opposite end such that the travel path of the second pivot point connecting the first link arm to the connecting link member remains substantially perpendicular to the channel when the linkage system is moved between a retracted and extended position and the angle through the second pivot point connecting the first link arm to the connecting link member and the sixth pivot point connecting the third link arm to the connecting link member remains substantially constant in relation to the channel when the linkage system is moved between a retracted and extended position.

The advantage of the linkage system of the invention is that it is able to control the angle of the movement of the connecting member in the second plane as reach is extended or retracted. The linkage system is also designed to ensure a lower manufacture cost compared with conventional systems.

Movement of the linkage system is occasioned by the application of force to the linkage system. Optionally the force can be applied by an actuator.

Ideally one end of the actuator is pivotally connected to the first link arm and the other end of the actuator is connected to a fixed location on the channel.

Alternatively or additionally the said other end of the actuator is pivotally mountable at a location on the second link arm.

The force applied by the actuator becomes a translational movement in which the actuator forces the movable mass to move in a first plane within the channel, thereby moving the first link arm and consequently forcing the connecting member to move along a second plane which is substantially perpendicular to the first plane. It is understood that any number of actuators can be used as required by the person skilled in the art.

Optionally in a further aspect of the invention, the third link means of the linkage system is a link arm or either a hydraulic or electrical ram which enables the linkage mechanism to provide an independent tilt mechanism. It is of course understood that the third link means of the linkage system is not limited to this type of independent tilt mechanism any suitable means to achieve an independent tilt known to a person skilled in the art can also be used. In operation the connecting link member will pivot about the pivot point connecting the first link arm. In this way the reach of the load carrying means is extended without magnification of the tilt moment as the reach is extended from the upright fork mast. This enables the linkage system to compensate for a load's tendency to angle the load carrying means toward the ground, which in turn reduces the risk of slippage of a load from the load carrying means.

In a further aspect of the invention a mounting member is positioned at a fixed location relative to the channel such that the pivot point connecting the first link arm of the linkage system to the moveable means and the pivot point connecting the second link arm to the mounting means are positioned on a centre line of the channel.

In a further aspect of the invention the distance between the pivot points on the first link arm, that is, the distance between the pivot point connecting the moveable means to the first link arm and the pivot point connecting the second link arm to the first link arm is substantially equal to the distance between the pivot point connecting the second link arm to the first link arm and the connecting link member to the first link arm are substantially equal.

In a further aspect of the invention, the distance between the pivot point connecting the second link arm to the first link arm and the pivot point connecting the second link arm to the mounting member is substantially equal to either of the distances between the pivot point connecting the moveable means to the first link arm and the pivot point connecting the second link arm to the first link arm or the pivot point connecting the second link arm to the first link arm and the connecting link member to the first link arm.

In a further aspect of the invention the linkage system of the invention is adapted for use with a material handling device. Ideally in this aspect of the invention a load carrying means is attached to the connecting link member of the linkage system. Optionally the connecting link member comprises at least one component to which the first link arm and second link arm are pivotally connected. It is of course understood that first connecting member can comprise any number of components suitable to achieve this purpose.

In a further aspect of the invention the actuator comprises a rod or a hydraulic or electrical ram. It is of course understood that any other type of suitable actuator known to the person skilled in the art could also be employed for this purpose.

In a further aspect of the invention the movable means comprises a component that is moveable between a first and second position within the channel. For example such components include a sliding mechanism or a rolling component. It is of course understood that any other type of suitable component known to the person skilled in the art could also be employed for this purpose.

In a further embodiment of the invention the channel is removably or slidably attached to an upright member such as an upright mast of a forklift truck.

In a further aspect of the invention, there is provided a forklift truck provided with the linkage system of the invention. Conveniently the forklift truck is adapted to be mounted on a carrying vehicle. Ideally in this aspect of the invention the load carrying means comprises a fork carriage and forks which are attached to the connecting link member of the linkage system.

Advantageously in this aspect of the invention the linkage system controls the angle of the load carrying means relative to the upright fork mast which houses the channel of the linkage system as the load carrying means moves between a retracted and extended position.

A further advantage is realised by the ability to fully retract the linkage system to within the confines of the channel thus reducing any overhang of the system.

In a further aspect of the invention, any one of the arms of the linkage system are optionally provided with an adjustable length at either end to account for manufacturing deviations or alternatively to enable an operator to adjust the tilt setting of the load carrying means.

In a further aspect of the invention, there is provided a wheel stabilisation mechanism for use with a reach system comprising a wheel assembly movably connected to a pivot assembly.

It is understood that the term reach system means a system that is suitable for altering the reach of a load carrying means such as for example, moving mast systems, telescopic forks or pantograph linkage arrangements. In a further aspect, the reach system is provided with load carrying means wherein the load carrying means are any one of stand alone detachable or adjustable forks, welded forks or alternatively a fork carriage having forks or tines attached thereto.

In a further aspect of the invention the wheel assembly comprises at least one wheel mounted such that the axis of rotation of the wheel is parallel to the axis of rotation of the pivot assembly. Thus in operation an actuator such as a ram extends forcing the pivot assembly to rotate about a pivot point, which in turn forces the wheel assembly downwards onto a loading surface whereby the wheel assembly rotates or rolls along the loading surface.

In a further aspect of the invention the wheel assembly optionally further comprises an actuator directly connected to the pivot assembly.

Optionally the wheel stabilisation mechanism further comprises additional rods or links for connecting rams or actuators as required by the person skilled in the art.

In a further aspect of the invention the wheel stabilisation mechanism comprise at least one wheel mounted such that the axis of rotation of the wheel is parallel to the axis of rotation of the pivot assembly and at least one wheel mounted such that the axis of rotation of the wheel is perpendicular to first wheel and to the axis of rotation of the pivot assembly.

Optionally the wheel stabilisation mechanism of the invention is mountable on either the fork carriage or the forks of the load carrying means. In a further aspect of the invention the wheel stabilisation mechanism can be incorporated for use into telescopic forks.

In a further aspect of the invention, the forks of the forklift are provided with a wheel stabilisation mechanism to allow side shift of the forks while the forks are bearing a load.

In a further aspect of the invention there is provided the linkage system of the invention for use with a reach system mounting a wheel stabilisation mechanism of the invention.

It is understood that conventional wheel stabilisation mechanisms could also be used with the linkage system of the invention.

It is also understood that although the linkage system of the invention and wheel stabilisation mechanism of the invention are described above with reference to a single component system. It is also understood that in practicable application the components of these systems can be increased as desired and that the increased number of components can by connected by various cross members, pins and so forth as required by a person skilled in the art.

DETAILED DESCRIPTION OF THE INVENTION

The invention will now be described more particularly with reference to the accompanying drawings, which show by way of example only various embodiments of the invention.

Figure 7:
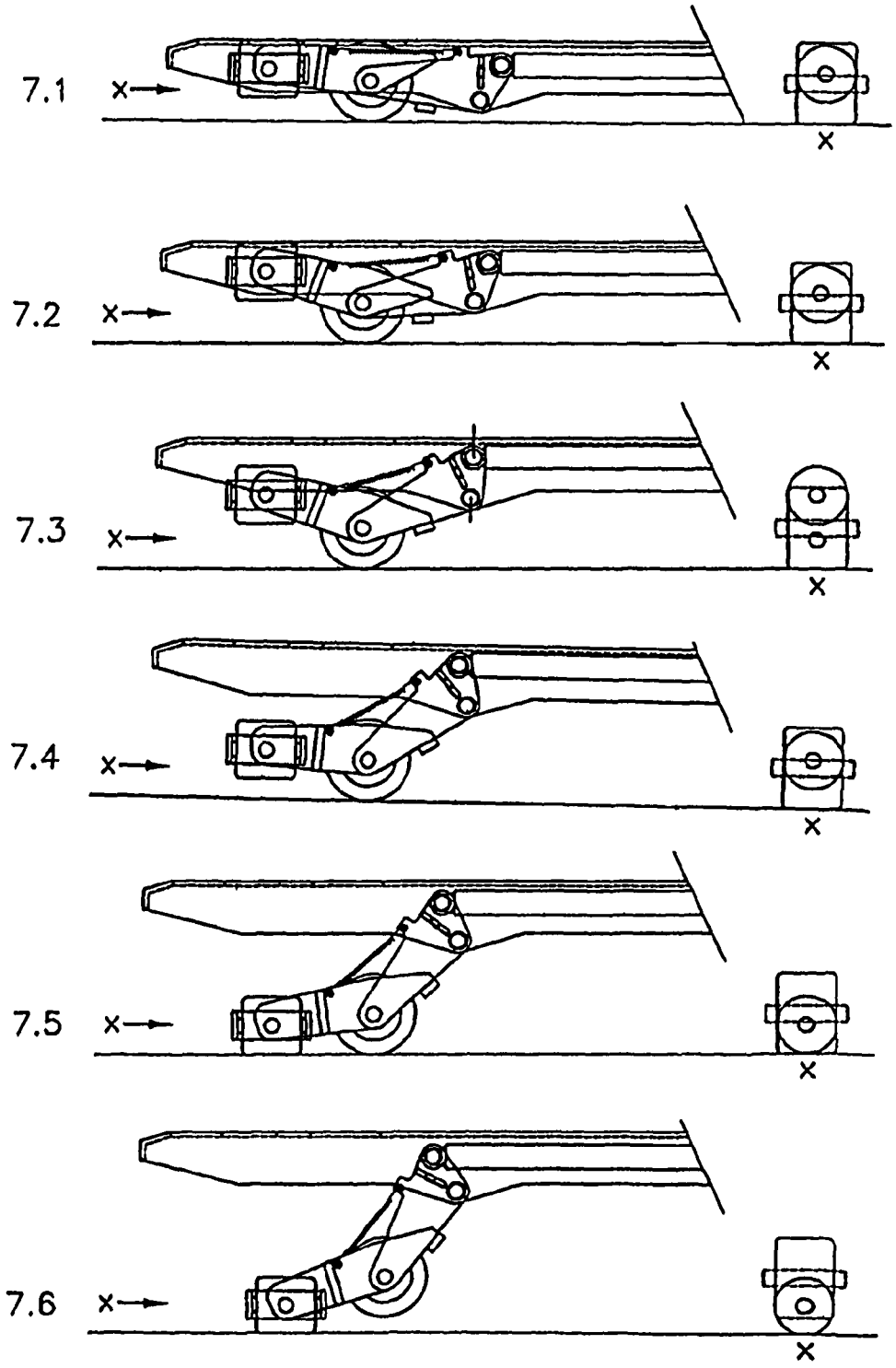
Figure 8:
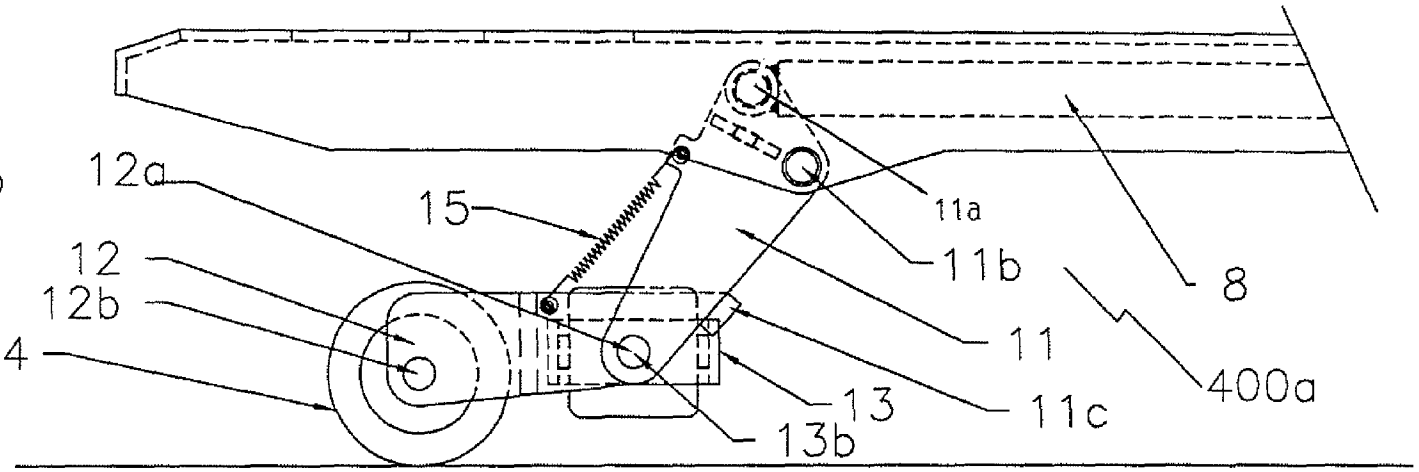
Figure 9:
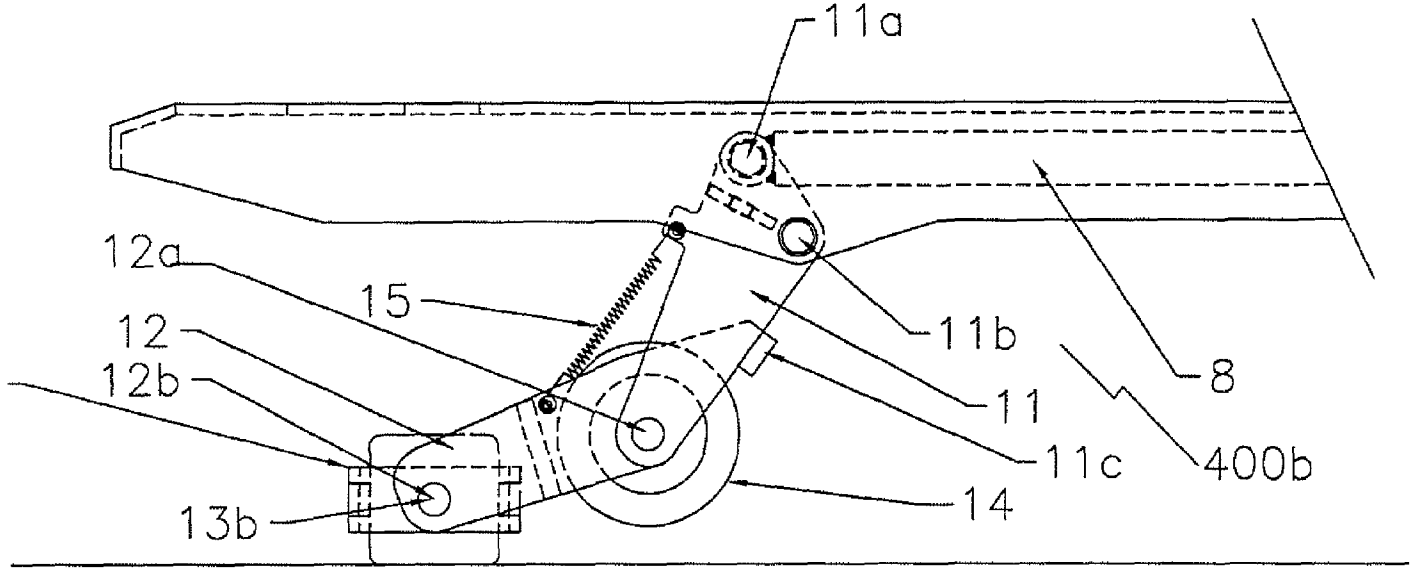
Figure 12:
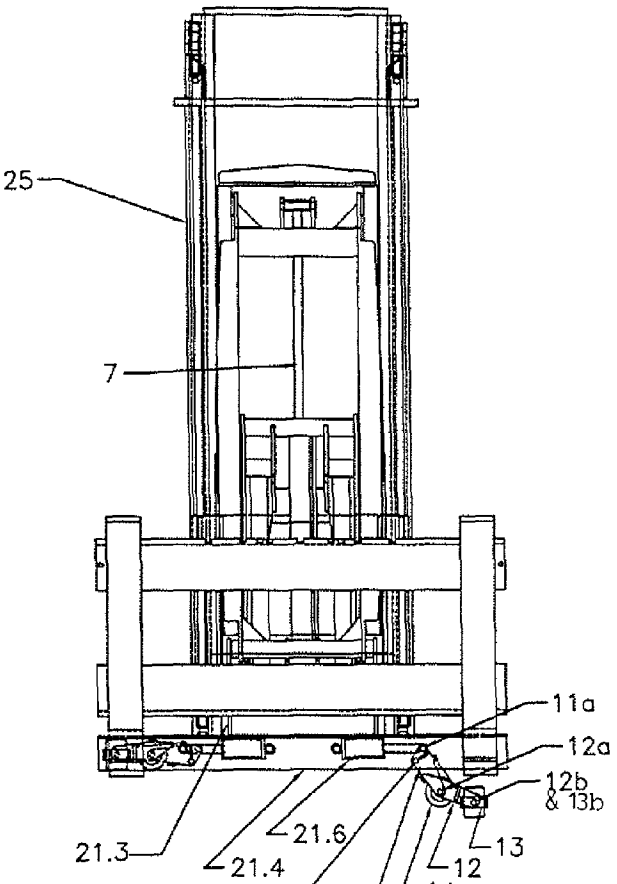
Figure 11:
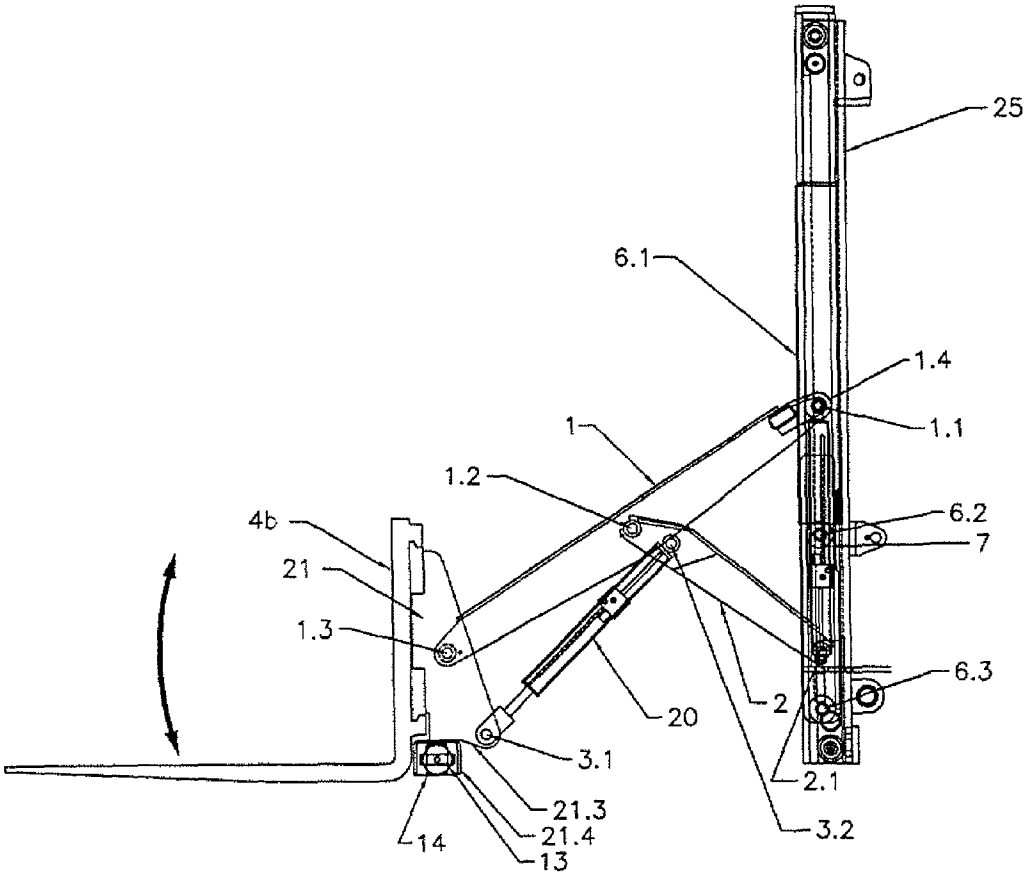

In the drawings,

FIGS. 1.1 to 1.8 show movement of points on the linkage system of the invention across a horizontal plane from an extended position to a retracted position;

FIG. 2.1 is a side view of the linkage system of the invention attached to load carrying means in an extended position;

FIG. 2.2 is a side view of the linkage system of the invention attached to load carrying means in a retracted position;

FIG. 3.1 is a side view of the linkage system of the invention attached to a walk behind forklift truck in an extended position;

FIG. 3.2 is a side view of the linkage system of the invention attached to a walk behind forklift truck in a retracted position;

FIG. 3.3 is a front view of the linkage system of FIG. 3.2;

FIG. 3.4 is a top view of the linkage system of FIG. 3.1;

FIGS. 4.1 to 4.4 and 5.1 are a side view of an unloading sequence using the linkage system of the invention attached to a walk behind forklift truck when removing a load from a first position on a raised surface;

FIG. 5.2 is a side view of an unloading sequence using the linkage system of the invention attached to a walk behind forklift truck when removing a load from a second position on a raised surface;

FIG. 5.3 is a side view of a walk behind forklift truck using the linkage system of the invention attached to a moving mast system;

FIG. 5.4 is a side view of a walk behind forklift truck using the wheeled stabilisation mechanism of the invention attached to a telescopic fork system;

FIGS. 6.1 to 6.6 and FIG. 8 are side views of a second wheel stabilisation mechanism of the invention showing the steps of how the first and second wheels engage as the ram travels through a stroke;

FIGS. 7.1 to 7.6 and FIG. 9 are side views of a third wheel stabilisation mechanism of the invention showing the steps of how the first and second wheels engage as the ram travels through a stroke;

FIGS. 10.1 and 10.2 are first and second side views of the transverse wheel assembly of the wheel stabilisation mechanism;

FIG. 10.3 is a top view of the transverse wheel assembly of the wheel stabilisation mechanism;

FIG. 11 is a side view of a independently tilting linkage mechanism of the invention attached to load carrying means in an extended position mounted in a low overhang configuration inside a conventional type duplex mast showing the stabilising wheel arrangement of the invention attached to the fork carriage; and FIG. 12 is a front view of FIG. 11 but in the retracted position.

Referring now to the drawings and specifically to FIGS. 1 to 5.4, there is shown a linkage system denoted generally by the reference numeral 300 which is suitable for use in a forklift truck 100, 100*a* and 100*b* of the kind shown specifically in FIGS. 3, 4 and 5.

Forklift trucks 100, 100*a* and 100*b* are the type of forklift truck known as a walk behind forklift truck. It is understood that the linkage system of the invention is not limited to use with this type of forklift truck. The linkage system of the invention is suitable for use with any forklift truck known to a person skilled in the art. The forklift truck 100, 100*a*, 100*b* is of the general type consisting of a U-shaped chassis comprising a base frame 200 mounting a rear steering wheel 201 which is driven by a motor (not shown) and controlled by steering arm 204. A pair of side frames 202 project from the base frame remote from the rear steering wheel 201. Each side frame 202 mounts a front wheel 203. The base frame 200 further mounts an upright mast 205 for carrying the linkage system 300 and forks 4. It is of course understood that the forklift truck of the invention further comprises a drive station having control means for all functions of the forklift. Forklift trucks 100, 100*a* and 100*b* differ from each other only in the means used to extend the reach of the forks. Forklift truck 100*a* has a moving mast system 205*a*, whilst forklift truck 100*b* employs telescopic forks 40. Although not shown it is understood that adjustable forks, a fork positioning means and side shift mechanisms are easily incorporated into overall design of the forklift truck or reach mechanism as desired.

Referring to FIGS. 2.1 and 3.1, there is shown a side view of the linkage system 300 of the invention wherein the linkage system 300 links upright mast 205 in a first plane to forks 4 in a second plane such that the forks 4 remains substantially perpendicular to the upright mast 205 when the linkage system 300 is in a retracted or expanded position. For clarity, the upright mast 205 shown is a simplex single stage configuration. It is understood that the linkage system 300 can be adapted to suit a varied array of lift masts with any number of stages.

The linkage system 300 comprises a first link arm 1 pivotally connected at one end to a roller 1.4 at point 1.1 which is vertically movable within the channel 6.1 of mounting carriage/member 6, and to the forks 4 at the opposite end via fork carriage 5 at pivot point 1.3. A second link arm 2 is pivotally connected to the first link arm 1 at pivot point 1.2. The opposite end of the second link arm 2 is pivotally connected to the mounting carriage/member 6 at pivot point 2.1. Pivot points 1.1 and 2.1 are positioned on or near the centre line of channel 6.1. The tilt angle of the forks 4 and fork carriage 5 is restricted by link arm 3 which is pivotally connected at one end to second link arm 2 at pivot point 3.2 and pivotally connected at the opposite end to the fork carriage 5 at pivot point 3.1. During operation link arm 3 forces the fork carriage 5 to rotate about pivot point 1.3 to compensate for the continuously changing angle of first link arm 1 while maintaining a generally fixed angle to channel 6.1 thus ensuring the forks 4 remain substantially horizontal throughout the movement of the linkage system. Movement of the linkage system 300 is actuated by ram 7 which is pivotally connected to mounting carriage/member 6 at point 7.1 and to first link arm 1 at pivot point 1.1. In an alternative arrangement ram 7 can be mounted at any suitable position on first link arm 1 or indeed on second link arm 2. It is also possible to mount ram 7 directly between first link arm 1 and second link arm 2 instead of using a mounting carriage/member 6. It is understood that any number of rams can be used as required by the person skilled in the art.

In this embodiment of the invention the second link arm 2 is connected to the first link arm 1 such that the distances between pivot points 1.1 to 1.2, 1.2 to 1.3 and 1.2 to 2.1 are all substantially equivalent.

The movement of linkage system 300 is shown in FIGS. 1.1 to 1.8. The force applied by hydraulic ram 7 becomes a translational movement in which pivot point 1.1 moves along the channel 6.1 in the first plane and pivot point 1.3 moves substantially along a second plane which is substantially perpendicular to the first plane regardless of the positioning of pivot points 3.1 or 3.2. FIG. 1.1 shows the linkage system 300 in a fully expanded position. FIGS. 1.2 to 1.7 shows the movement of the pivot points of the linkage system along the x and y axes as the linkage system 300 moves into a retracted position. Referring specifically to FIG. 1.7 it is shown how the components of the linkage system 300 fully retract into channels 6.1. When fully retracted pivot points 1.1 and 2.1 are positioned on or near the centre line of channel 6.1 together with 1.2 and 1.3. Pivot point 3.1 is positioned rearward of the centre line of channel 6.1 thus allowing the linkage system 300 to fully retract into channels 6.1 while remaining structurally stable. This significantly reduces the overhang when the forklift is mounted on a carrying vehicle. FIG. 1.8 is an amalgamation of the points of movement shown in FIGS. 1.1 to 1.7 permitted by the linkage system 300.

As stated previously, the link arm 3 restricts and controls the angle of the forks 4 and fork carriage 5 relative to the channel 6.1 and thus the mounting carriage/member 6. The main purpose of link arm 3 is to keep the forks 4 generally horizontal throughout travel from the extended to retracted positions; however a minor change in the position of pivot points 3.1 and/or 3.2 will result in the fork carriage 5 changing angle during this same movement. This can be advantageous as it is possible to fine-tune the linkage system 300, for example, to give an automatic tilt downwards by a fixed angle when the linkage system 300 is extended and automatic tilt upward by a fixed angle when the linkage system 300 is retracted. This option can be used as an alternative to an independent tilt system or merely as a fine adjustment to compensate for bending moments when the linkage system is extended.

For the purposes of clarity the description of linkage systems and wheel stabilisation mechanisms above references components as single parts. However, in practicable application of these systems most components are duplicated and connected by various cross members, pins etc, many of which can be identified in front elevation view FIG. 3.3 and plan view FIG. 3.4. In addition the layering of the links can be arranged in many ways. FIG. 3.3 shows channel 6.1 outside all of the main linkage system 300 components, the next component in the sequence is first link arm 1, subsequently second link arm 2 and finally link arm 3 in the innermost position. It is understood that linkage system 300 components can be arranged in any sequence to achieve the same movement. It is also understood that although the linkage system 300 is described with reference to roller 1.4 any other movable means which allow a pivoting movement together with a sliding movement within channel 6.1 can be used for example a pivoting wear pad arrangement.

Although not shown it is understood that an adjustable length link can be provided at either end of the arms or linkage components to account for manufacturing deviations or alternatively to enable an operator to adjust the tilt setting of the load carrying means.

Wheel stabilisation mechanism 400 is shown in FIGS. 2.1 and 2.2 as an integrated part of fork 4. The assembly is shown in the fully deployed position in FIG. 2.1 and in the fully retracted position in FIG. 2.2. Pivot assembly 11 is pivotally connected to forks 4 at pivot point **11*b*. Pivot assembly 11 is also connected to wheel assembly 10 at pivot point 12*a* and to ram 8 at pivot point 11*a*. Ram 8 is also pivotally connected to the fork 4 at pivot point 8*a*. Wheel assembly 10 is shown with two forward facing wheels; however it is understood that wheel assembly 10 can be replaced with a single forward facing wheel mounted on pivot point 12*a* to simplify components. In operation ram 8 extends forcing pivot assembly 11 to rotate about pivot point 11*b* forcing wheel assembly 10 downward on the loading surface hence raising the fork 4** sufficiently to elevate a load clear from the loading surface.

Another embodiment of the linkage system of the invention 300 is shown in FIGS. 11 and 12 incorporating several options that can be used either individually or in combination. Linkage system 300 is shown constructed in a narrow version and fitted inside a standard type duplex mast 25. The duplex mast 25 is shown in very basic form without lift rams, chains or rollers for clarity. A modified mounting carriage/member 6 is used with bearing mounting points 6.2 & 6.3 fitted with outwardly facing roller bearings (not shown) to engage the corresponding inner channels on the duplex mast 25 so that pivot points 1.1 & 2.1 and channel 6.1 are located on or near the centreline of duplex mast 25. This mounting arrangement will allow the linkage system 300 to be fitted to a wide range of forklift masts in a compact low overhang configuration.

It is understood that any suitable type of load carrying means can be attached onto any type of fork carriage that enable pivot points 1.3 and 3.1 to be fitted as required. FIG. 11 shows linkage system 300 fitted with standard type forks 22 fitted to alternative fork carriage 21. Various types of fork positioner, side shift or wheel stabilisation mechanism can be incorporated for use with the linkage systems 300.

In this embodiment of the linkage system of the invention fixed length link arm 3 is replaced with hydraulic ram 20 to provide an independent tilt mechanism. Extension of the hydraulic ram 20 will force fork carriage 21 to tilt or rotate upwards without movement of link arm 1 or 2. Of course the stroke of tilt ram 20 can be designed to give a maximum amount of tilt forwards and rewards as desired. It is advantageous to tilt at or near the fork carriage so there is no magnification of tilt moment when the reach is extended resulting in reduced stresses and improved controllability.

FIGS. 4.1 to 4.4 and 5.1 to 5.2 depict forklift 100 lifting loads **110*a* and 110*b* from a raised surface 111*a*, in this case a trailer 111. Referring to FIG. 4.1 the linkage system 300 of FIG. 2.1 is connected to forklift 100 in an extended position while wheeled stabilisation mechanism 400 is shown in a retracted position. In FIG. 4.2 the forklift 100 has moved forward so that forks 4 have engaged with load 110*a*. Once the forks are fully engaged, the wheel stabilisation mechanism 400 is deployed and engages with the surface 111*a* of trailer 111 as shown in FIG. 4.3. As the wheel stabilisation mechanism 400 full lowers, it raises the load 110*a* relative to the trailer surface 111*a* and hence most of the weight is carried by the wheel assembly 10 of wheel stabilisation mechanism 400. Load 110***a* is retracted by the linkage system 300 while the wheel assembly 10 of wheel stabilisation mechanism 400 allows smooth transfer of the load as shown in FIG. 4.4. Forklift 100 is supporting very little of the load 110*a* until this point when it safely lifts the load clear of the trailer 111 with the linkage system 300 in the fully retracted position as shown in FIG. 5.1.

Forklift 100 is shown in FIG. 5.2 engaging the second load 110*b* at the far side of the trailer in the same manner as load 110*a* as already described. In this instance, the front wheels of the forklift 100 travel under the trailer 111 to gain the required position.

However, in some cases this may not be possible because of larger forklift wheels or lower trailer elements that restrict access. FIG. 5.3 shows an alternative configuration consisting of a moving mast forklift 100*a* with the linkage system 300 and wheel stabilisation mechanism 400. Again the wheel stabilisation mechanism 400 supports the load 110*b* while the linkage system 300 retracts the load. The moving mast is then retracted (not shown) until the load can be raised safely. FIG. 5.4 shows that the wheel stabilisation mechanism 400 can be also used with other reach systems. In this case forklift 100*b* is fitted with modified telescopic forks 40 incorporating the wheel stabilisation mechanism 400. Operation of the system will be similar to that previously described.

FIGS. 6, 7, 8 and 9 show further embodiments of a wheel stabilisation mechanism 400*a* and 400*b* respectively. Wheel stabilisation mechanisms 400*a* and 400*b* are both fitted with transverse wheel arrangements which enable an operator to employ the side shift mechanism of the forklift which is not possible with the first embodiment of the wheel stabilisation mechanism 400.

Wheel stabilisation mechanism 400*a* is shown in FIGS. 6.1 to 6.6 and 8. Specifically FIGS. 6.1 to 6.6 show a sequence of steps using the second embodiment of the wheel stabilisation mechanism 400*a*, however in operation there will be a continuous movement from position 6.1 to 6.4 and then from 6.4 to 6.6. In FIG. 6.1, shows the assembly in the fully retracted position. In this position the straight wheel 14 is in use whilst the transverse wheel assembly 13 is elevated to allow clearance to enter a pallet and to allow for smooth forward travel. FIGS. 6.2 to 6.4 show the transverse wheel assembly 13 being lowered by extending ram 8 while straight wheel 14 is kept elevated against stop plate 11*c* by tension spring 15. FIGS. 6.5 and 6.6 shows the transition to full deployment of the wheel stabilisation mechanism 400*a* by further extension of ram 8. In this fully deployed state, the straight wheel 14 is in full contact with the loading surface and transverse wheel assembly 13 is in an elevated redundant position.

Referring specifically to FIG. 8 and FIGS. 10.1 to 10.3, pivot assembly 11 is pivotally connected to forks 4 at pivot point 11*b*. Pivot assembly 11 is also connected to wheel connection means 12 at pivot point 12*a* and to ram 8 at pivot point 11*a*. Tension spring 15 also connects pivot assembly 11 to wheel connection means 12. Straight wheel 14 is connected to wheel connection means 12 at point 12*b* and transverse wheel assembly 13 is pivotally connected to connection means 12 at pivot point 12*a*. FIGS. 10.1 to 10.3 show transverse wheel assembly 13 in plan elevation and end view respectively. Wheel 13.1 is connected to pivoting cradle 13.3 through axis 13.2 which are located perpendicular to mounting pivot point 13*b*. Pivot point 13*b* in turn connects to wheel connection means 12 at pivot point 12*a*. This arrangement ensures that transverse wheel assembly 13 can pivot throughout the operation of wheel stabilisation mechanism 400*a* ensuring correct contact with the load-bearing surface.

Wheel stabilisation mechanism 400*b* is shown in FIGS. 7.1 to 7.6, 9 and 10.1 to 10.3. As before FIGS. 7.1 to 7.6, show a sequence of steps using the third embodiment of the wheel stabilisation mechanism 400*b*. Typically in order to use wheel stabilisation mechanism 400*b* it is necessary to deploy fully before sideshifting the forks 4 using the transverse wheel assembly 13 and subsequently lower the load slightly to reengage the straight wheel 14 before retracting the linkage mechanism 300 or any other suitable reach system. This is achieved in a similar manner as before using stop plate 11*c* and tension spring 15. In FIG. 7.1, the straight wheel 14 is in use when fully retracted whilst the transverse wheel 13 is elevated to allow clearance to enter pallet. FIGS. 7.2 to 7.4 show ram 8 extending causing the forks 4 to lift and the straight wheel 14 to drop until the forks 4 have reached approximately three-quarters stroke causing the pallet to be elevated. FIGS. 7.5 and 7.6 shows the transition to full deployment of the wheel stabilisation mechanism 400*b* by further extension of ram 8. In this fully deployed state, the transverse wheel assembly 13 is in full contact with the loading surface and straight wheel 14 is in an elevated redundant position.

Referring specifically to FIG. 9 and FIGS. 10.1 to 10.3, pivot assembly 11 is pivotally connected to forks 4 at pivot point 11*b*. Pivot assembly 11 is also connected to wheel connection means 12 at pivot point 12*a* and to ram 8 at pivot point 11*a*. Tension spring 15 also connects pivot assembly 11 to wheel connection means 12. Straight wheel 14 is connected to wheel connection means 12 at point 12*a* and transverse wheel assembly 13 is pivotally connected to connection means 12 at pivot point 12*b*. FIGS. 10.1 to 10.3 show transverse wheel assembly 13 in plan elevation and end view respectively. Wheel 13.1 is connected to pivoting cradle 13.3 through axis 13.2 which are located perpendicular to mounting pivot point 13*b*. Pivot point 13*b* in turn connects to wheel connection means 12 at pivot point 12*b*. This arrangement ensures that transverse wheel assembly 13 can pivot throughout the operation of wheel stabilisation mechanism 400*a* ensuring correct contact with the load-bearing surface.

As shown in FIGS. 11 and 12 it is also possible to mount the wheel stabilisation mechanism 400, 400*a* and 400*b* to the fork carriage 2. The wheel stabilisation mechanism 400*b* is fitted under the fork carriage 21. In operation the transverse wheels 14 are in contact with the surface from first contact until the forks have raised and elevated the load. The straight wheel 13 will come in contact from there to full height and the load can be retracted.

It is to be understood that both wheels will be lowered together, however FIGS. 11 and 12 show one wheel stabilisation mechanism up and one wheel stabilisation mechanism down for clarity.

The wheel stabilisation mechanisms 400, 400*a* and 400*b* can be actuated by placing the ram in other locations on the forks 4 or on the fork carriage 21 either with a direct coupling as shown or through a series of rods, links or pivot links. It is also possible to actuate the two forks with one ram through a simple linkage system.

The linkage system 300 of the invention can be fitted with a standard fork carriage or any other type of sideshift or fork positioner fork carriage with or without wheel stabilisation mechanism 400, 400*a* and 400*b*.

Generally conventional straddle type truck mounted forklifts are capable of lifting approximately 30% of the unladen forklift weight at full extension if fitted with a single reach system, for example lifting the first load 110*a*, and are capable of lifting approximately 100% its unladen weight if front mounted jack legs are deployed. If a double reach system is used with jack legs deployed the lift capacity will be again reduced to approximately 30% of the forklifts unladen weight so for example a 3000 kg forklift is needed to lift 1000 Kg in load position 110*b*. In contract, a straddle type truck mounted forklift fitted with one of the aforementioned Wheel stabilisation mechanisms can greatly increase rated load capacity for a given forklift weight as the only restricting factor is the design strength and power in retracted reach mode. It is therefore possible for this type of forklift to lift 200% its own unladen weight either with single reach to lift from load position 110*a* or with double reach to lift from position 110*b* with or without front mounted jack legs, so for example a 1000 kg forklift of this type can lift in excess of 2000 kg.

It will of course be understood that the invention is not limited to the specific details described herein, which are given by way of example only, and that various modifications and alterations are possible within the scope of the invention as defined in the appended Claims 1 to 23.

The invention claimed is:

1. A forklift truck comprising:

a linkage system for movement of load carrying means; and a base frame, wherein said linkage system comprises:

a moveable means contained within a channel;

a first link arm pivotally connected to the moveable means at a first pivot point and a connecting link member at a second pivot point;

a second link arm pivotally connected substantially near a midpoint of the first link arm at a third pivot point and at a fixed point relative to the channel substantially near a centerline of the channel at a fourth pivot point;

a third link means pivotally connected to the second link arm at a fifth pivot point and to the connecting link member at a sixth pivot point at the opposite end, wherein the second pivot point connecting the first link arm to the connecting link member is configured to have a travel path that remains substantially perpendicular to the channel when the linkage system is moved between a retracted and extended position and the angle through the second pivot point connecting the first link arm to the connecting link member and the sixth pivot point connecting the third link arm to the connecting link member is configured to remain substantially constant in relation to the channel when the linkage system is moved between a retracted and extended position; and a wheel stabilization mechanism, wherein the wheel stabilization mechanism is located at or adjacent the front end of the forks of the forklift and the wheel stabilization mechanism comprises at least one wheel movably connected to a pivot assembly which is mounted such that the axis of rotation of the wheel is parallel to the axis o rotation of the pivot assembly and at least one wheel is mounted such that the axis of rotation of the wheel is perpendicular to the first wheel and to the axis of rotation of the pivot assembly.

2. The forklift truck of claim 1, further comprising an actuator, wherein the actuator is configured to move the linkage system by the application of force from the actuator to the linkage system.

3. The forklift truck of claim 2, wherein one end of the actuator is pivotally connected to the first link arm and the other end of the actuator is connected to a fixed location on the channel.

4. The forklift truck of claim 3, wherein the other end of the actuator is pivotally mountable to a location on the second link arm.

5. The forklift truck of claim 1, wherein the third link means of the linkage system is a link arm, a hydraulic or electrical ram which enables the linkage mechanism to provide an independent tilt mechanism.

6. The forklift truck of claim 1, wherein a mounting member is positioned at a fixed location relative to the channel such that the pivot point connecting the first link arm of the linkage system to the moveable means and the pivot point connecting the second link arm to the mounting member are positioned on a centerline of the channel.

7. The forklift truck of claim 1, wherein the distance between the pivot point connecting the moveable means to the first link arm and the pivot point connecting the second link arm to the first link arm is substantially equal to the distance between the pivot point connecting the second link arm to the first link arm and the connecting link member to the first link arm are substantially equal.

8. The forklift truck of claim 6, wherein the distance between the pivot point connecting the second link arm to the first link arm and the pivot point connecting the second link arm to the mounting member is substantially equal to the distances between the pivot point connecting the moveable means to the first link arm and the pivot point connecting the second link arm to the first link arm, or the pivot point connecting the second link arm to the first link arm and the connecting link member to the first link arm.

9. The forklift truck of claim 1, wherein the load carrying means is attached to the connecting link member of the linkage system, wherein the connecting link member comprises at least one component to which the first link arm and third link means are pivotally connected.

10. The forklift truck of claim 1, wherein the movable means comprises a component that is configured to be moveable between a first and second position within the channel, where the component is a sliding mechanism or a rolling component.

11. The forklift truck of claim 1, further comprising an upright forklift mast, wherein the channel is removably or slidably attached to the upright forklift mast.

12. The forklift truck of claim 1, wherein the forklift truck is adapted to be mounted on a carrying vehicle, and the load carrying means comprises a fork carriage and forks which are attached to the connecting link member of the linkage system.

13. The forklift truck of claim 11, wherein the linkage system is configured to additionally control the angle of the load carrying means relative to the upright forklift mast which houses the channel of the linkage system as the load carrying means moves between a retracted and extended position, whereby the linkage system is fully retractable to within the confines of the channel thus reducing any overhang of the system.

14. The forklift truck of claim 1, wherein any one of the arms of the linkage system is provided with an adjustable length at either end configured to account for manufacturing deviations or to enable an operator to adjust the tilt setting of the load carrying means.

15. The forklift truck of claim 5, wherein the wheel assembly comprises at least one wheel mounted such that the axis of rotation of the wheel is parallel to the axis of rotation of the pivot assembly.

16. The forklift truck of claim 1, wherein the wheel assembly comprises an actuator directly connected to the pivot assembly.

17. The forklift truck further comprises additional rods or links for connecting rams or actuators.

18. The forklift truck of claim 1, wherein the wheel stabilization mechanism is incorporated for use into telescopic forks.

19. A forklift truck comprising:

a linkage system for movement of load carrying means; and a base frame, wherein said linkage system comprises:

a moveable means contained within a channel;

a first link arm pivotally connected to the moveable means at a first pivot point and a connecting link member at a second pivot point;

a second link arm pivotally connected substantially near a midpoint of the first link arm at a third pivot point and at a fixed point relative to the channel substantially near a centerline of the channel at a fourth pivot point;

a third link means pivotally connected to the second link arm at a fifth pivot point and to the connecting link member at a sixth pivot point at the opposite end, wherein the second pivot point connecting the first link arm to the connecting link member is configured to have a travel path that remains substantially perpendicular to the channel when the linkage system is moved between a retracted and extended position and the angle through the second pivot point connecting the first link arm to the connecting link member and the sixth pivot point connecting the third link arm to the connecting link member is configured to remain substantially constant in relation to the channel when the linkage system is moved between a retracted and extended position; and a wheel stabilization mechanism, wherein the wheel stabilization mechanism is located at or adjacent the front end of the forks of the forklift and the wheel stabilization mechanism is configured on the forks to allow side shift of the forks while the forks are bearing a load.

20. The forklift truck of claim 1, further comprising an integrated side shift system.

* * * * *